United States Patent [19]

Cornell

[11] 3,980,381

[45] Sept. 14, 1976

[54] CABLE CONNECTOR

[75] Inventor: Paul A. Cornell, Knockanore, Ireland

[73] Assignee: Electro-Clamp Corporation, Beverly Hills, Calif.

[22] Filed: Sept. 26, 1974

[21] Appl. No.: 509,321

[52] U.S. Cl. ..... 339/100; 339/248 R; 339/266 R; 339/275 R

[51] Int. Cl.[2] ..... H01R 7/20; H01R 9/08

[58] Field of Search ..... 339/95 R, 100, 266, 339/270, 274, 248, 249, 275

[56] References Cited

UNITED STATES PATENTS

| | | | |
|---|---|---|---|
| 2,680,145 | 6/1954 | Lanfear | 339/248 X |
| 2,906,990 | 9/1959 | Cain et al. | 339/270 R |
| 3,138,422 | 6/1964 | Lawlor | 339/266 R |
| 3,351,889 | 11/1967 | Lawlor et al. | 339/266 R |
| 3,406,372 | 10/1968 | Lawlor | 339/266 R |
| 3,411,129 | 11/1968 | Peters | 339/100 |
| 3,579,177 | 5/1971 | Lawlor | 339/266 R |
| 3,801,952 | 4/1974 | Lawlor | 339/266 R |
| 3,831,134 | 8/1974 | Cornell et al. | 330/266 R |

FOREIGN PATENTS OR APPLICATIONS

| | | | |
|---|---|---|---|
| 1,145,085 | 3/1969 | United Kingdom | 339/266 R |

*Primary Examiner*—Roy Lake
*Assistant Examiner*—Neil Abrams
*Attorney, Agent, or Firm*—Hume, Clement, Brinks, Willain, Olds, & Cook, Ltd.

[57] ABSTRACT

An improved cable clamp of the hinged-jaw type is disclosed utilizing a male jaw having a C-shaped cross sectional configuration to enhance the spring action of the clamp. The female jaw includes a pocket for receiving the butt end of the clamp. This pocket in conjunction with an adjacent pressure surface on the male jaw causes lateral deformation of the cable within the clamp to increase pull-out resistance and lessen the tendency for cable twist. Altenative embodiments utilize transverse recesses in the male head to save on materials and pairs of hinged jaws for use in in-line connectors.

10 Claims, 12 Drawing Figures

CABLE CONNECTOR

BACKGROUND OF THE INVENTION

The present invention relates generally to cable-clamping devices and, more particularly to improvements in hinged-jaw, non-shearing cable clamps. The cable connectors of the present invention may be used for electrical and nonelectrical purposes, and they are particularly effective for use with aluminum cables.

The cable clamps which utilize hinged-jaw clamping means are known in the art, as disclosed in the following patents:

| | | |
|---|---|---|
| Schuk et al. | 2118720 | Electrical Connector. |
| Lawlor | 3138422 | Electrical Connector With Wire-Gripping Means. |
| Lawlor et al. | 3351889 | Electrical Connector, etc. |
| Lawlor | 3406372 | Non-Shear, etc. Electrical Connector. |
| Beaudion | 3437979 | Electrical Connector With Wire-Gripping Means. |
| Lawlor | 3477060 | Electrical Connector Of Integral Sheet Metal. |
| Tracy | 3169818 | Electrical Conductor Clamp. |
| Peterson | 2700807 | Guy Wire Clamp. |
| Goetzelman | 1955283 | Ground Connector. |
| Lanfear | 2680145 | Wire Connector. |
| Lawlor | 3579177 | Terminal Board Electrical Connector. |

One of the advantages associated with this type of cable clamp is that the sleeve design of the female jaw provides a spring effect, when clamped onto a cable, thereby applying a constant pressure thereto. This feature is of increasing importance since clamps of this type are being used more often in conjunction with cables made from materials which exhibit "cold flow" tendencies as, for example, aluminum. When a fixed position connector is used with such a cable, there exists the danger that the connection will eventually loosen. With hinged-jaw connectors, however, this problem is lessened since, as the cold flow occurs, the spring characteristics of the female jaw allow the clamp to move with the flow of the cable and to maintain a constant pressure thereon, thereby preventing any loosening of the connection.

One of the disadvantages associated with the hinged-jaw clamping devices of the prior art is that they are essentially, terminal cable clamps; that is, they are used to clamp the end of a cable to a fixed body or anchor. Thus, the clamps of the prior art are not suitable for in-line connection of two cables without the use of some supporting structure.

SUMMARY OF THE INVENTION

The present invention improves upon the clamping devices of the prior art in that it provides a cable clamp having enhanced spring action due to the design of the male jaw member and an increased pull-out resistance which allows use of the device under more severe and exacting conditions of tension, vibration, heat, etc. These features are realized while at the same time effecting a cost savings of the manufacture of the clamp through a reduction in the amounts of material used in its construction. The cable clamps of the present invention are also characterized by their simplicity, ease of installation and reliability.

Finally, one embodiment of the present invention provides a suitable clamping device for the in-line connection of two separate cables.

In accordance with one embodiment of the present invention the improved cable clamp includes a male jaw and a female jaw both having respective mounting tails extending generally tangentially therefrom. The male jaw includes a cylindrical, transverse head having a C-shaped cross-sectional configuration. The male jaw also includes a cable-receiving opening which extends diametrically through the male head with the ends of this opening being enlarged in a plane normal to the hinge axis. The female jaw includes a coupling sleeve together with an intermediate cable receiving body and a mounting tail which extends tangentially from this body. The coupling sleeve has a cable-receiving opening and an internal cylindrical bearing surface which engages the external surface of the male head to allow hinging movements of the jaws between open and closed positions. Finally, the intermediate body portion includes a pocket for receiving the butt end of the cable. This pocket makes possible the lateral deformation of the cable thereby increasing pull-out resistance and preventing twisting of the cable within the clamp. The pocket also provides a means for increasing electrical conductivity when the clamp is used for electrical connections.

In another embodiment of the present invention the improved cable-clamp utilizes an improved cylindrical male head which has a transversely extending recess positioned thereon at a point generally opposite to the attachment point of the male jaw mounting tail. A further alternative embodiment includes the utilization of a pair of transversely extending recesses, each generally coincident with, but smaller than, the enlarged ends of the male head opening. These embodiments effect substantial savings of material thereby lowering the cost of construction.

In accordance with a final embodiment of the present invention for use as an in-line connector, the cable clamp is provided with a base, a pair of male and female jaws, and means for effecting hinging movements of the jaws. The base is of a generally longitudinal configuration having two oppositely facing ends with pockets therein for receiving the cable ends. The male jaws each include a transverse cylindrical head and a mounting tail extending generally tangentially therefrom. The male jaws also include a cable receiving opening which extends diametrically through the male head with the ends of this opening being enlarged in a plane normal to the hinge axis. The female jaws are formed integral with the base member and extend from opposite ends thereof. Each female jaw includes a coupling sleeve having a cylindrical internal bearing surface which engages one of the male jaw heads to allow hinging movements of the male jaws between open and closed positions. Each female jaw also includes a cable-receiving opening or aperture which is in diametrically opposed alignment with one of the base member pockets. Finally, mechanical means are provided which cooperated with the base member and the mounting tails of each male jaw for simultaneously affecting hinging movements of the male jaw within their respective female jaws between the open and closed positions of the clamp.

BRIEF DESCRIPTION OF THE DRAWINGS

The novel features of the present invention are set forth with particularity in the appended claims. The invention together with further objects and advantages thereof may best be understood, however, by reference to the following description taken in conjunction with the accompanying drawings in which like reference numerals identify like elements and in which:

DESCRIPTION OF THE PREFERRED EMBODIMENTS

Figure 1:
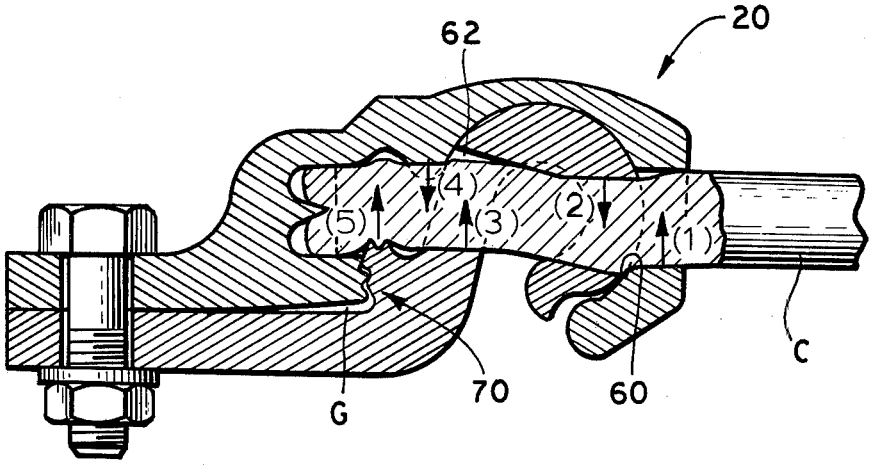
FIG. 1 is a side elevational view, in cross-section, illustrating the cable clamp of the present invention having enhanced spring effect and increased pull-out resistance.
Figure 2:
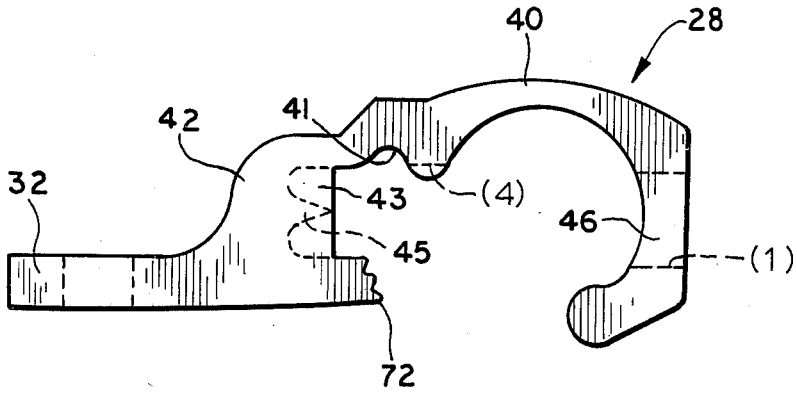
FIGS. 2 and 3 are side elevational views of the female and male jaws, respectively, which make up the cable clamp illustrated in FIG. 1.
Figure 3:
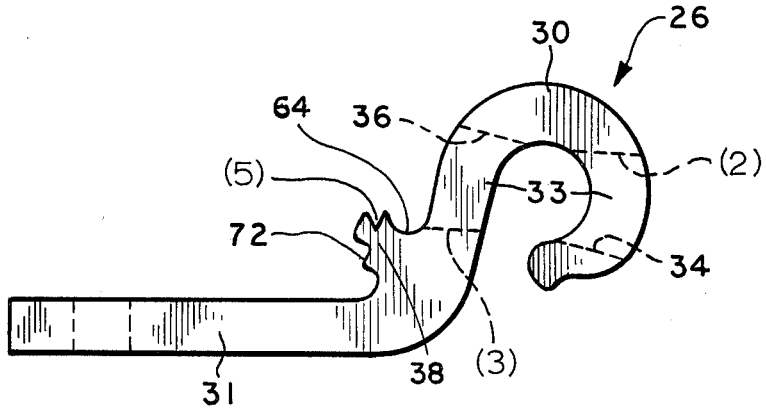

Referring now to the embodiment shown in FIGS. 1–3, the cable-clamping device, designated generally as 20, is shown FIG. 1 in the closed position engaging the butt end of the cable C. The clamping device 20 includes both male and female jaw members, 26 and 28 respectively. The male jaw includes a transverse cylindrical head 30 and a mounting tail 31 which extends generally tangent therefrom. The male head 30 has a C-shaped cross-sectional configuration in order to provide increased and amplified spring-like forces to bear upon the cable C when the device is in the closed cable-clamping position. Because of the forces within the clamp when it is in the closed position, the female jaw 28 is urged in a clockwise direction while at the same time the male jaw 26 is urged in a counter-clockwise direction. Therefore, as is clearly shown in FIG. 1, when the clamp is in the closed position a gap or spacing G will exist between male mounting tail 31 and the female mounting tail 32.

Therefore, as the cable tends to cold flow both the female and male jaws can move to maintain a constant clamping pressure. Of course, the design of the male head also effects substantial savings of material over the solid head male jaws of the prior art. The male head 30 is also provided with a cable-receiving opening 33 which extends generally diametrically therethrough and which includes enlarged ends 34, 36. Thus, the male head opening 33 is of the X-shaped type which is shown in the Lawlor U.S. Pat. No. 3,406,372, having a generally uniform width in the horizontal plane and broadened dimension at each end in the vertical plane normal to the hinge axis.

The female jaw 28 includes a coupling sleeve 40 an intermediate cable-receiving body portion 42 and a mounting tail 32 which extends therefrom. The intermediate body portion 42 is spaced from the male head 30 and has a cable-receiving pocket 43 which faces toward the coupling sleeve 40. The female jaw 28 also includes a cable-receiving opening 46, positioned in the coupling sleeve 40, which is in diametrically opposed alignment with the pocket 43.

The male head opening 33 is disposed within the male jaw head 26 in substantially the manner as described in the Lawlor U.S. Pat. No. 3,406,372. Therefore, the male head opening 33 is in substantially linear alignment with the pocket 43 and opening 46 when the clamping device is in the open position. Likewise, the male head opening 33 is offset from this linear alignment when the clamping device is in the closed position.

The clamping device of the present invention is ideally suited for connection and securement of cables under high tension, vibration and other exacting conditions. As noted above the design of the male jaw provides enhanced spring action to overcome the effects of cold flow encountered with some materials used today in the manufacture of cable. Furthermore, a design of the male and female jaws is such that substantially increased cable pull-out resistance is obtained. Five pressure surfaces 1, 2, 3, 4, and 5 are provided, each exerting forces, against the cable as indicated by the arrows in FIG. 1. The pressure surface 1 is located in the cable receiving opening 46 of coupling sleeve 40; pressure surfaces 2 and 3 are located diametrically opposed to one another at the ends of the male head opening 33; the pressure surface 4 is positioned on the female jaw 28 intermediate coupling sleeve 40 and the base member 42; and, the pressure surface 5 is located on the male jaw 26 intermediate the male jaw head 30 and the mounting tail 31. As can be clearly seen in FIG. 1, when the cable connecting device is in the closed position these pressure surfaces effect alternating opposing forces against the cable C, which forces are exerted in a common plane normal to the hinge axis.

It will also be noted that the enlarged ends 34, 36 of the male head opening 33 provide, when the clamp is in the closed position, first and second cavities 60, 62 adjacent the first and fourth pressure surfaces, respectively. These cavities have a sufficient depth such that, with the clamp in the closed position, the pressure surfaces 2 and 3 may deform the longitudinally adjacent portions of the cable C into cavities 60 and 62 to thereby increase the cable pull-out resistance. Similarly, the male jaw includes, between the pressure surface 5 and the male head 26, a depression 64 of sufficient depth that the pressure surface 4 may deform a longitudinally adjacent portion of the cable C into the depression 64 to further increase the cable pull-out resistance. Finally, the pressure surface 5, preferably a transversely extending ridge, projects into the space or recess between the intermediate body 42 and the male head 30 adjacent the cable receiving pocket 43 when the clamp is closed. However, the force brought to bear by the pressure surface (5) cannot effect complete vertical deformation of the cable C since the butt end of the cable is disposed within the pocket 43. The effect, therefore, upon a standard cable utilized with this device is that lateral deformation will occur, thereby increasing even further the cable pull-out resistance and also inhibiting any tendency of the cable toward a twisting action which might facilitate slippage of the cable in the clamp under cable tension. It should be noted that the pressure surfaces (1) to (4), because of the relatively large areas thereof acting on the cable, do not produce any shearing action which tends to cause weaknesses in the connection at the points of grip, especially where the cable is under high tension load. A further description of the construction, features and advantages of the pressure surfaces and the cavities disclosed hereinabove is hereby incorporated by reference to copending U.S. Pat. application Ser. No. 418,290, filed Nov. 23, 1973, now U.S. Pat. No. 3,861,771.

Further advantages of the present invention will be appreciated when the improved cable clamping device is used for electrical applications. When used in this enviroment the cable connector makes use of the butt end of the cable to increase electrical conduction. Oxidation is a problem which is frequently encountered with aluminum cable. The oxidation products form an insulating skin around the surface of the cable and also around the individual strands of the cable (while being extruded.) As a result, the interior of such cables used with surface contacting clamps may be insulated from the clamp thereby causing a poor electrical connection. Of course, the degree to which this insulating effect occurs depends on the extent of oxidation of the cable. According to this feature of the invention, the clamp 20 is constructed of an electrically conductive material and the pocket 43 includes piercing means 45 which are secured to the seat of the pocket 43 and extend outwardly therefrom. The piercing means 45 may be, for example one or more spikes which are tooled into the seat of the pocket 43. These spikes will slide between the strands of the cable end, breaking down the oxidation and increasing contact between the cable and the connector, thereby enhancing electrical conductivity.

Of course, these spikes may be tooled on a separate disk which may be either tapped onto the butt end of the cable prior to inserting it into the connector or seated in the pocket prior to insertion of the cable.

Figure 4:
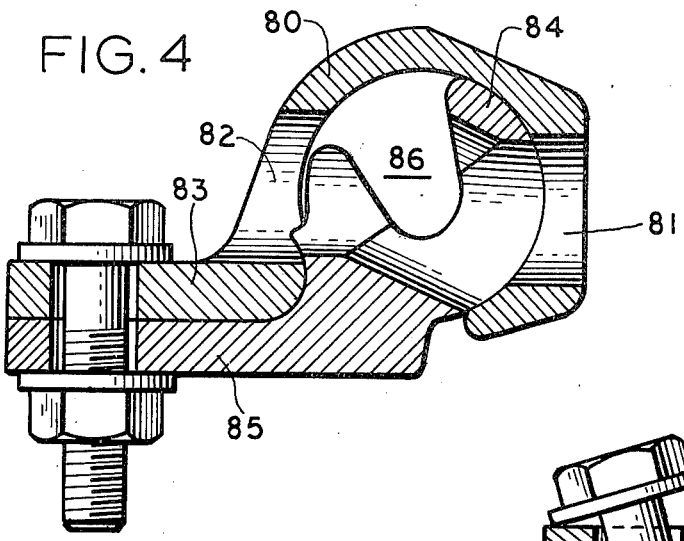
FIGS. 4, 5, and 6 are side elevational views, in cross-section, illustrating another embodiment of the cable clamp of the present invention utilizing alternative structural configurations for the head component of the male jaw member.
Figure 5:
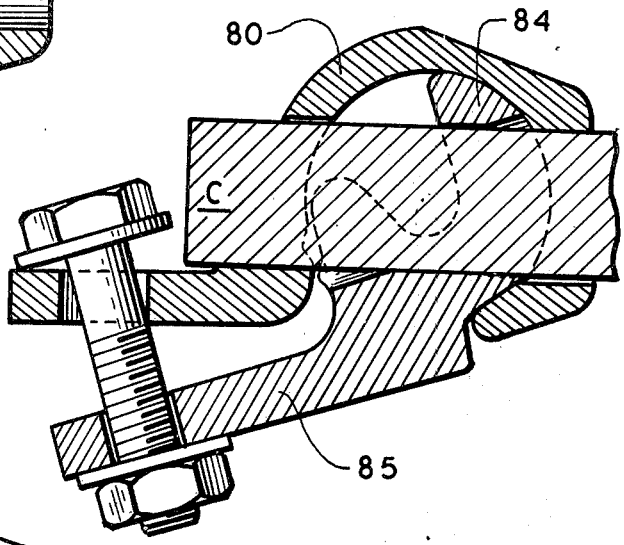
Figure 6:
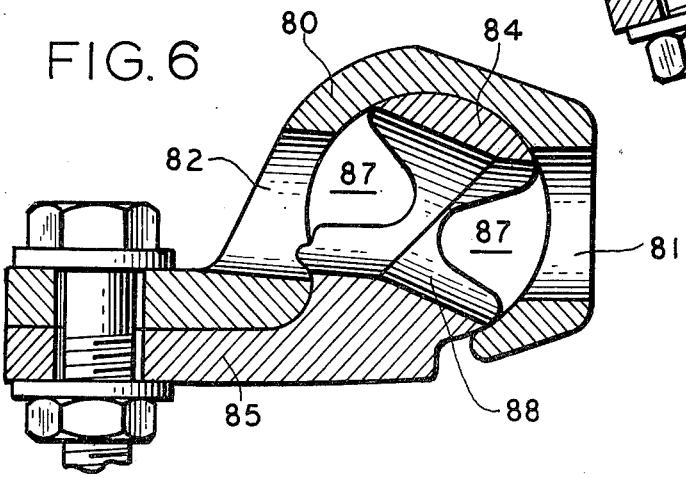

FIGS. 4 through 6 illustrate an alternative structural embodiment of the improved clamp of the present invention. In this embodiment the female jaw comprises a coupling sleeve 80 having diametrically opposed cable-receiving apertures 81, 82 and a mounting tail 83 which extends tangentially from the sleeve 80. The male jaw is shown to have a generally cylindrical male head 84 with the mounting tail 85 extending generally tangent thereto. However, in order to save substantial amounts of material and thereby reduce significantly the cost of construction, the male head 84 includes, on a portion thereof generally opposite to the point of attachment of the mounting tail 85, a transverse generally U-shaped recess 86. FIG. 4 shows the recess 86 to have a depth greater than the radius of the male head 84 and a width at the circumference of head 84 extending from a point generally central to the aperture 82 to a point generally intermediate of apertures 81 and 82. However, the specific configuration and size of the recess 86 will of course depend upon the materials of the construction and the overall size of the clamp. The object of this embodiment is to minimize the amount of material used in the male jaw member while maintaining the required degree of structural strength therein. Alternatively, as shown in FIG. 6, the male head 84 includes, on portions thereof which are generally coincident with the enlarged ends of the male head opening, two generally transverse U-shaped recesses 87. The recesses 87 have a depth less than the radius of the male head 84 and a width, at the surface of the head, less than that of the ends of male head opening 88. From the foregoing it will be understood that the clamps having recesses 86 or 87 in their male jaw members function in substantially the same manner as do the clamps illustrated in FIGS. 1 through 3 and described hereinabove.

Figure 7:
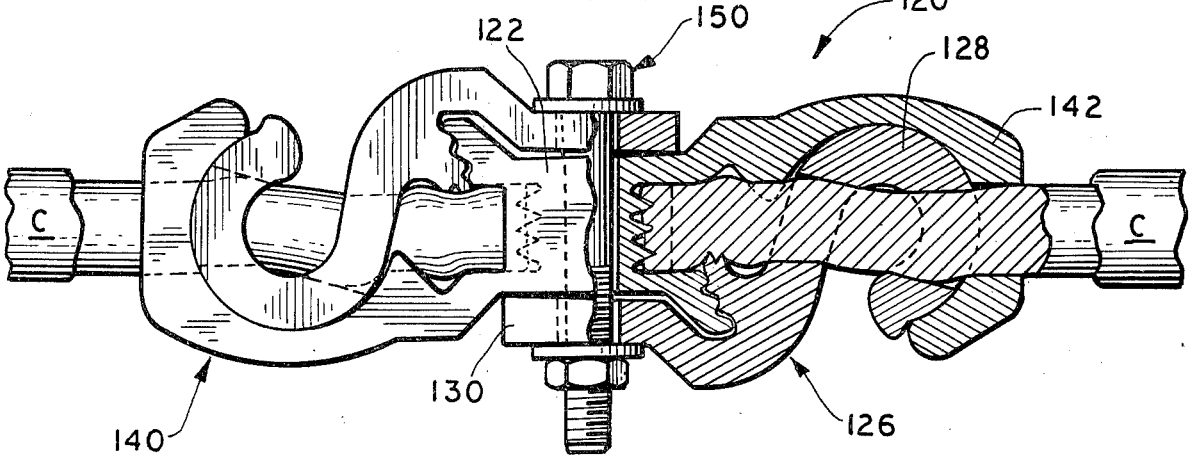
FIG. 7 is a side elevational view; in partial section, illustrating the in-line cable connecting device of the present invention in the closed, cable-clamping position with the ends of the two cables engaged therein.
Figure 8:
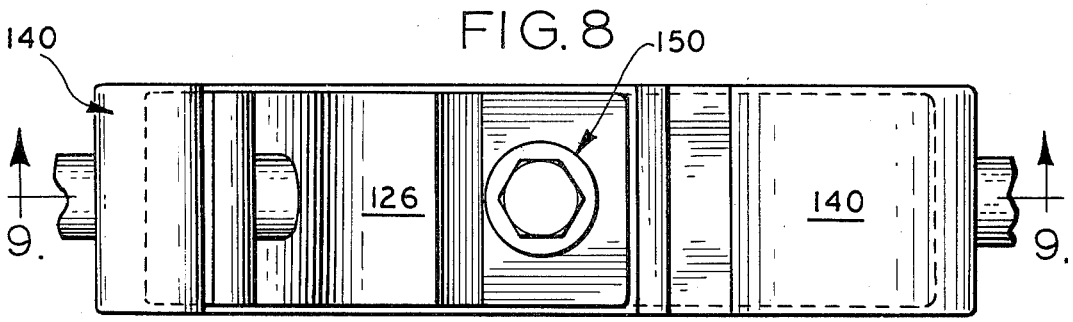
FIG. 8 is a plan view of the device as shown in FIG. 7.
Figure 9:
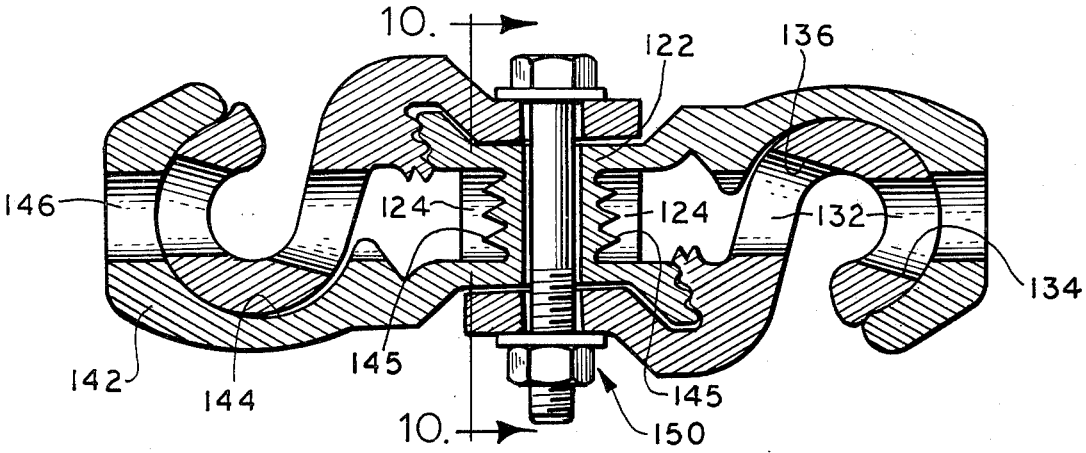
FIG. 9 is a side elevational view of the cable-connecting device, similar to that shown in FIG. 7.

Referring now to FIGS. 7–9, the cable connecting device, designated generally as 120, is shown in the closed, cable-clamping position engaging the ends of two cables. The clamping device 120 includes a base member 122 which is of a generally longitudinal configuration having disposed in opposite ends thereof cable receiving pockets 124. A pair of male jaws 126 are used in conjunction with each cable-connecting device. Each male jaw includes a transverse cylindrical head 128 and a mounting tail 130 which extends generally tangent therefrom. The male head 128 may be of a solid configuration; however, it is preferred that the male head have a generally C-shaped cross-sectional configuration, as does the embodiment shown in FIG. 1, in order to provide amplified spring forces. In either case, the male head 128 is provided with a cable-receiving opening 132 which extends generally diametrically therethrough and which includes enlarged ends 134, 136. Thus, the male head opening 132 is of the X-shaped type which is shown in the Lawlor U.S. Pat. No. 3,406,372, having a generally uniform width in the plane parallel to the hinge axis and a broadened dimension at each end in the medial plane normal to such axis. The female jaws 140 are formed integral with the base member 122 and extend from the opposite ends thereof. Each female jaw 140 includes a coupling sleeve 142 having a cylindrical internal bearing surface 144 which receives and engages one of the male jaw heads 128 to allow hinging movements of the male jaws 126 between open and closed positions. Each female jaw 140 also includes a cable-receiving opening 146 which is in diametrically opposed alignment with one of the pockets 124.

The male head openings 132 are disposed within the male jaw heads 128 in the manner substantially as described in the Lawlor U.S. Pat. No. 3,406,372. Therefore, the male head openings 132 are in substantially linear alignment with the pockets 124 and the sleeve openings 146 when the cable-connecting device is in an open position. Likewise, the male head openings 132 are offset from this linear alignment when the cable-connecting device is in a closed position.

In order that the cable connector of the present invention may be expeditiously utilized it is necessary that self clamping means be provided. Therefore, clamping means, designated generally as 150, cooperate with the base member 122 and the male jaw mounting tails 130 so as to simultaneously effect hinging movements of the two male jaws 126. The preferred embodiment comprises a bolt and nut arrangement disposed within a central bore which is substantially perpendicular to the longitudinal axis of the cable connecting device. Of course, other clamping means may be utilized to effect the hinging movements required in the present device, and these will be readily apparent to those skilled in the art.

Figure 10:
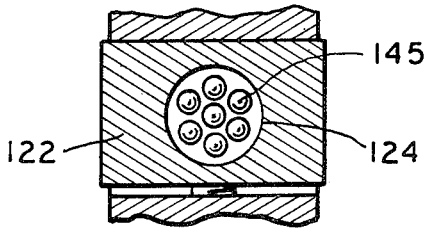
FIG. 10 is a cross-sectional view taken along lines 10—10 of FIG. 9, and showing with greater particularity the cable receiving pocket and cable piercing features of the present invention.

It will be apparent from the foregoing descriptions that the important features of enhanced pull-out resistance and increased spring action are both realized in the in-line connector in the same manner as discussed hereinabove for the embodiment illustrated in FIG. 1. Thus, each of the clamps of the in-line connector illustrated in FIGS. 7–9 has five pressure surfaces which effect alternating opposing forces on the cable C in a plane normal to the hinge axis. Moreover, each clamp also produces lateral deformation of the butt ends of the cables, as described above, to further enhance pull-out resistance and to prevent twisting of the cables while the connector is in the closed position. Finally, as is clearly shown in FIGS. 9 and 10, the in-line connector also incorporates a cable piercing means 145 similar to that disclosed above. The piercing means 145 may consist of one or more spikes which are secured to the seat of pocket 124 and extend outwardly therefrom. These spikes will pierce the butt ends of the cables and thereby enhance the conductivity of the connector.

Figure 11:
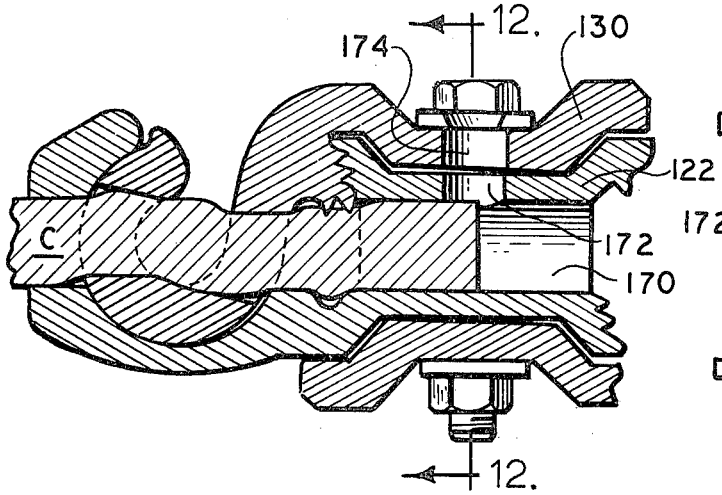
FIG. 11 is a partial side elevational view of an alternative embodiment of the in-line cable connecting device of the present invention for use in electrical applications.
Figure 12:
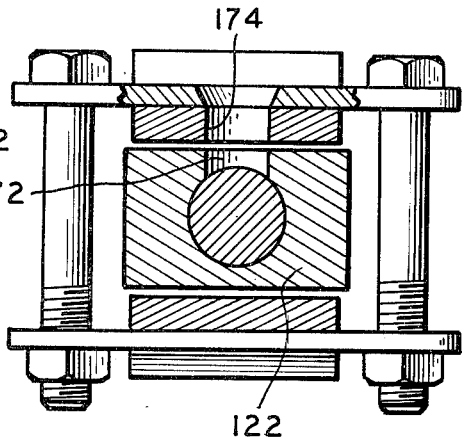
FIG. 12 is a cross-sectional view taken along lines 12—12 of FIG. 11.

Another alternative embodiment of the in-line cable connecting device of the present invention is illustrated in FIGS. 11 and 12. In this embodiment, for use primarily in electrical applications, the pockets 124 extend completely through base 122 thereby forming a single axial bore 170. Base 122 also includes a third pocket 172 which extends perpendicularly from a central portion of the axial bore 170 to a lateral surface of base 122. At least one of the male mounting tails 130 should also have an aperture 174 in alignment with the pocket 172. In the use of this embodiment of the invention, and prior to closing the connector to the cable-clamping position, the butt ends of the cable would be pushed together at the central portion of axial bore 170. Subsequent to closing the connector, an electrically conductive material would be introduced to the joint via aperture 174 and pocket 172. The material may be poured as a molten metal into the joint and allowed to cool, thereby forming a solid one piece connection. Alternatively, a soft, compactable metal could be tamped down into pocket 172 to bind the butt end strands together.

Another feature of the invention is the latch means 70, illustrated in the embodiments shown in FIGS. 1 and 7. This latch functions to hold the connector to the cables when the connector is partly closed with enough pressure to grip the cable so that assembly of the entire in-line connection can be expeditiously completed without risk of the connector dropping off the cables. In FIG. 1 for example, the latch means 70 is disposed at the junction of the female mounting tail 32 and the offset shoulder 38 which is located on male jaw 26 between the mounting tail 31 and the head 30. Preferably, the latch means 70 comprises at least one pair of fine parallel teeth extending transversely on the offset shoulder 38 and on the adjacent end surface of mounting tail 32. The latch teeth 72 are so related to one another as to make interferring engagement as the male jaw approaches the female jaw. Moreover, when a series of teeth 72 are utilized, the male jaw 26 may be held at any one of a number of selected intermediate attitudes between the open and closed positions.

Finally, the cable clamps illustrated and described herein may be suitably manufactured by extrusion methods which are both fast and economical. Such methods may be utilized for both the male and female jaws and the integral female jaw-base pieces of the in-line connector. Of course, the cable receiving openings both in the female and male jaws and the various pockets must be tooled into their respective pieces subsequent to any extrusion operation. The clamps of the present invention may be ideally manufactured from various synthetic resin materials and metals. However, it is important that the material of manufacture process sufficient hardness, tensile strength and resiliency to withstand the substantial tension loads which may be encountered upon application.

It should be understood that various modifications and changes of the preferred embodiments described herein can be made without departing from the spirit and scope of the present invention and without diminishing its attendant advantages. Such modification and changes are, of course, intended to be covered by the following claims.

I claim:

1. A cable clamp comprising:

a male jaw having a transverse cylindrical head and a mounting tail extending therefrom, said male head having a generally diametrical, cable-receiving opening and said male mounting tail having a raised pressure surface adjacent said male head;

a female jaw having a coupling sleeve, an intermediate cable-receiving body and a mounting tail extending from said body, said coupling sleeve including a cable-receiving opening and an internal surface engaging said male head to allow hinging movements of said jaws between open and closed positions, said intermediate body being spaced from said male head and including a pocket for receiving the butt end of said cable;

said male head opening, said coupling sleeve opening and said pocket being in generally linear alignment when the clamp is in an open, cable-receiving position, and said male head opening being offset from said linear alignment when the clamp is in a closed cable-clamping position; and said raised pressure surface projecting between said intermediate body and said male head to laterally deform said cable when the clamp is closed.

2. The improved clamp defined in claim 1 wherein said pocket includes means for piercing the butt end of said cable to enhance the electrical conductivity between said clamp and said cable.

3. The improved clamp defined in claim 2 wherein said piercing means comprises at least one spike which is secured to said pocket and extends outwardly therefrom.

4. The improved clamp defined in claim 1 wherein said female jaw has a first pressure surface within said sleeve opening and a fourth pressure surface intermediate said coupling sleeve and said cable-receiving body, and said male jaw has second and third pressure surfaces at opposite ends of said male head opening and wherein said raised pressure surface acts as a fifth pressure surface intermediate said male head and said male jaw mounting tail, whereby, when the clamp is in a closed position, said pressure surfaces effect alternating opposing forces against said cable in a common plane normal to the hinge axis.

5. The improved clamp defined in claim 4 wherein said fifth pressure surface is a transversely extending ridge.

6. A cable clamp for in-line connection of two cables comprising:

a base having two oppositely facing ends with pockets therein for receiving said cables;

a pair of male jaws each including a transverse cylindrical head and a mounting tail extending therefrom, each male head having a generally diametrical, cable-receiving opening and each mounting tail having a raised pressure surface adjacent said male head;

a pair of female jaws extending from said opposite ends of said base, each female jaw including a coupling sleeve having a cylindrical internal bearing surface engaging one of said male jaw heads to allow relative hinging movements of said male jaws between open and closed positions, each female jaw also including a cable-receiving opening in axial alignment with one of said pockets;

said male head openings being in substantial linear alignment with said pockets and said sleeve openings when the clamp is in an open, cable-receiving position, and said male head openings being offset from said linear alignment when the clamp is in a closed, cable-clamping position;

means cooperating with said base and said male mounting tails for simultaneously effecting the hinging movements of said male jaws within their respective female jaws between said open and closed positions, and each said raised pressure surface projecting between one of said base ends and its respective male head to laterally deform said cables when the clamp is closed.

7. The cable clamp defined in claim 6 wherein at least said base is constructed from an electrically conductive material and said pockets include means for piercing said cable ends to increase conduction between said cable and said clamp.

8. The cable clamp defined in claim 6 wherein each said female jaw has a first pressure surface within said sleeve opening and a fourth pressure surface intermediate said coupling sleeve and said base, and each said male jaw has a second and third pressure surface at the ends of said head opening and wherein said raised pressure surface acts as a fifth pressure surface intermediate said head and said mounting tail; whereby, when the clamp is in a closed position, said pressure surfaces effect alternating opposing forces against said cables in a common plane normal to the hinge axis.

9. The cable clamp defined in claim 8 wherein said fifth pressure surface is a transversely extending ridge.

10. A cable clamp for in-line connection of two cables comprising:

a base having two oppositely facing ends and a single axial bore which extends through each said end, whereby the butt-ends of said cables may be joined centrally of said base, said base also including a second bore which extends perpendicularly from the central portion of said axial bore to a lateral surface of said base;

a pair of male jaws each including a transverse cylindrical head and a mounting tail extending therefrom, each male head having a generally diametrical, cable-receiving opening;

a pair of female jaws extending from said opposite ends of said base, each female jaw including a coupling sleeve having a cylindrical internal bearing surface engaging one of said male jaw heads to allow relative hinging movements of said male jaws between open and closed positions, each female jaw also including a cable-receiving opening in axial alignment with said axial bore;

said male head openings being in substantial linear alignment with said axial bore and said sleeve openings when the clamp is in an open, cable-receiving position, and said male head openings being offset from said linear alignment when the clamp is in a closed, cable-clamping position; and means cooperating with said base and said male mounting tails for simultaneously effecting the hinging movements of said male jaws within their respective female jaws between said open and closed positions.

* * * * *